United States Patent [19]

Stepe

[11] 4,069,604

[45] Jan. 24, 1978

[54] END WEAR BIT FOR EARTHMOVING EQUIPMENT BLADES

[75] Inventor: Visvaldis A. Stepe, Willow Springs, Ill.

[73] Assignee: Caterpillar Tractor Co., Peoria, Ill.

[21] Appl. No.: 783,102

[22] Filed: Mar. 31, 1977

[51] Int. Cl.[2] ..... E02F 9/28; A01B 35/22

[52] U.S. Cl. ..... 37/141 T; 172/702; 172/719; 172/737; 172/703

[58] Field of Search ..... 37/141 R, 141 T, 142 R; 172/702, 737, 719, 777, 703, 704

[56] References Cited

U.S. PATENT DOCUMENTS

| | | | |
|---|---|---|---|
| 2,464,227 | 3/1949 | Gurries et al. | 37/DIG. 13 |
| 2,831,275 | 4/1958 | Kimsey et al. | 37/141 R |
| 2,965,989 | 12/1960 | Hibbard | 37/141 R |
| 3,994,084 | 11/1976 | Smith et al. | 172/737 X |
| 4,010,561 | 3/1977 | Klett | 37/141 T |

FOREIGN PATENT DOCUMENTS

| | | | |
|---|---|---|---|
| 113,645 | 8/1941 | Australia | 172/737 |
| 607,667 | 11/1960 | Canada | 37/103 |

*Primary Examiner*—E. H. Eickholt
*Attorney, Agent, or Firm*—James R. Bell

[57] ABSTRACT

An end wear bit for earthmoving equipment blades includes a symmetrically constructed plate having a plurality of divergent rows of apertures formed therein.

5 Claims, 2 Drawing Figures

END WEAR BIT FOR EARTHMOVING EQUIPMENT BLADES

BACKGROUND OF THE INVENTION

1. Field of the Invention

This invention relates generally to excavating and more particularly to the digging edge of scoops used in excavating.

2. Description of the Prior Art

In earthmoving equipment, the leading edge of the blade is subjected to extreme wear due to the continual action of soil, rocks and the like, abrading away on the leading edges. Various devices have been proposed for protecting the blade leading edges. These devices are generally in the form of replaceable bits mounted on the blade in a position to provide an extra wear surface. The bits are usually indexible with respect to the blade for continual repositioning to provide a new wear surface. Since most blade wear occurs at its lower outside corners, the bits are usually placed there. As a result, some of the known blades are reversible. Some known indexible bits expose an equal amount of new wear material at their inside and outside edges as the bit is incrementally indexed from a first row of apertures to a second parallel row of apertures. Others include non-parallel or diverging rows of apertures but pivot about a single point during indexing. As a result these bits expose substantially no new wear surface at the inside edge but progressively expose more wear material at the outside edge. It would be an advantage to have a reversible, indexible bit which provides new material all along the edge of the bit with an increased amount of material at the outside corners of the blade where the greatest amount of blade wear occurs.

SUMMARY OF THE INVENTION

The present invention is directed to overcoming one or more of the problems as set forth above.

According to the present invention, this is accomplished by providing an end wear bit for earthmoving equipment blades including a plate having a plurality of divergent rows of apertures formed therein. The plate is of a construction sufficient for including first and second symmetrical portions.

The foregoing and other advantages and novel features will become apparent from the following detailed description when considered in conjunction with the accompanying drawings. It is to be expressly understood, however, that the drawings are not intended as a definition of the invention but are for the purpose of illustration only.

DESCRIPTION OF THE PREFERRED EMBODIMENT

Figure 1:
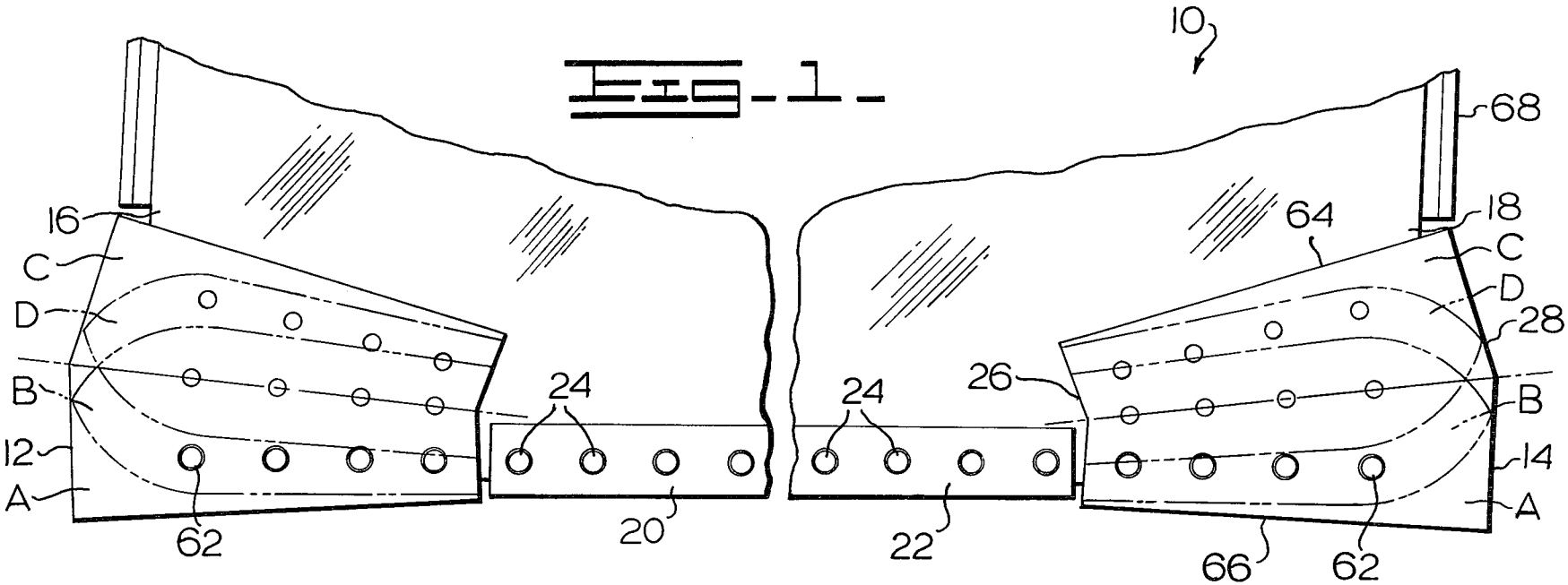
FIG. 1 is a partial frontal view of an earthmoving equipment blade including end bits attached at the outside corners.

Referring now to the drawings, an earthmoving equipment blade is generally designated 10, and includes reversible, indexible, flat steel plates or end bits 12,14 connected to the lower outside blade corners 16,18, respectively, as viewed in FIG. 1. Lower ground engaging edge 20 of blade 10 includes an elongated reinforcing plate 22 attached thereto by bolts 24.

Figure 2:
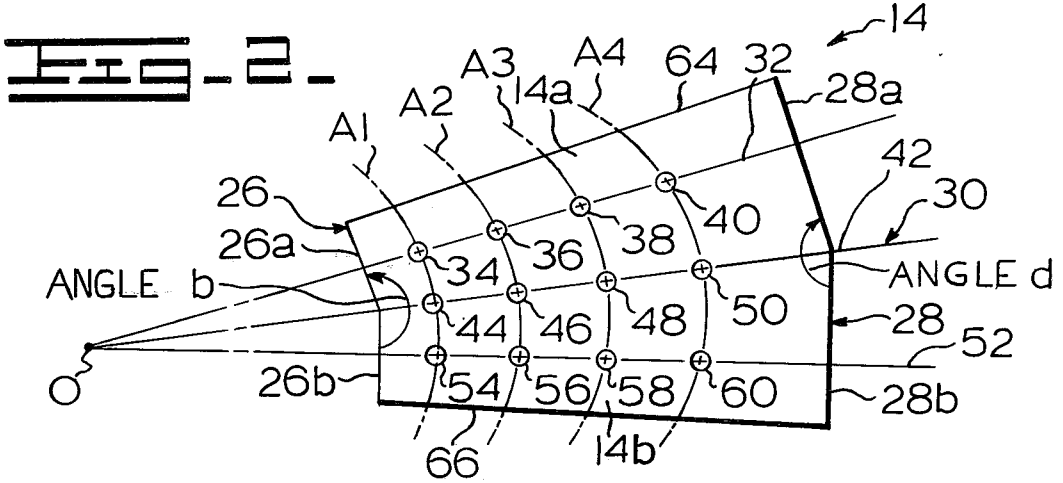
FIG. 2 is an enlarged planar view illustrating the end bit of this invention.

End bits 12,14 are substantially identical in geometric configuration and include a first short edge 26 and a second relatively longer edge 28, FIG. 2. Unitary bit 14 is shown bisected into two substantially symmetrical portions *14a,14b* as illustrated by a bisecting line designated 30 shown for the purpose of this discussion. Line 30 intersects the edges 26,28. Thus, short edge 26 is bisected into two substantially equivalent portions *26a,26b*. Similarly, longer edge 28 is bisected into two substantially equivalent portions *28a,28b*.

Bisected portions *26a,26b* of first edge 26 are relatively angularly disposed at some angle slightly greater than 180° designated beta or *b*. This angular disposition accommodates the slight rotational movement of the bit as it is indexed from row to relatively diverging row. Bisected portions *28a,28b* of second edge 28 are similarly angularly disposed at angle delta or *d* for the purpose of eliminating the presence of an exposed bit corner, for example at the intersection of the upper outside edges 64,28, respectively, which would otherwise protrude beyond edge 68 of blade 10.

A plurality of rows of apertures are formed in bits 12,14. Each row is exclusive with respect to each other row between edges 26,28. Also, each row is relatively divergent between the edges 26,28. A row designated 32 includes apertures 34,36,38,40. A row designated 42 is coincident with bisecting line 30 and includes apertures 44,46,48,50 and a row designated 52 includes the apertures 54,56,58 and 60. Thus it can be seen that no one of the rows shares an aperture. Also, each row 32, 42,52 is relatively divergent or non-parallel so that those rows, if extended beyond edge 28, do not meet. The rows will intersect at some point designated 0 when the rows are extended beyond edge 26 opposite edge 28. By using point 0 as a center point or locus, progressively greater radii, corresponding to the distance between the holes, can be used to strike arcs $A_1$, $A_2$, $A_3$, and $A_4$. It is along these arcs that the equally spaced holes will therefore occur.

Each aperture in row 32 is relatively equally spaced apart. Similarly, each aperture in row 42 is relatively equally spaced apart as are the apertures in row 52. The spacing of these apertures corresponds to the equal spacing of bolt holes on blade 10 which accommodate bolts 24 attaching reinforcing plate 22 to the blade as well as bolts 62 attaching bits 12,14 to blade 10, FIG. 1. Since the spacing of the apertures on each bit 12,14 corresponds to the spacing of bolt holes on the blade, the corresponding apertures and thus the bit and blade are relatively indexible.

As illustrated, substantially symmetrical bit portions *14a,14b* each include an equal number of rows on opposite sides of bisecting line 30. It is to be understood that the number of rows may vary in order to vary the number of times the bit 14 can be indexed with respect to the blade 10. The advantage of providing an equal number of rows on opposite sides of line 30 is to ensure total reversibility of the bits 12,14 so as to be interchangeable between opposite lower outside corners 16,18 of blade 10 or to be flipped over in place.

Diverging or non-parallel aperture rows 32,42,52 are also diverging with respect to upper and lower edges 64,66, respectively. Thus, for example, when row 52 of bit 14 is first attached to blade 10 it can be seen that first wear area designated A includes some exposed wear surface adjacent first edge 26 and an increased exposed wear surface adjacent second or outside edge 28 where the most wear occurs. Similarly, it can be seen that when row 42 is aligned with the blade 10 for attachment, second wear area designated B includes some exposed wear surface adjacent first edge 26 and an increased wear surface adjacent second edge 28. This can occur due to the diverging relationship between each row 32,42,52 and the upper and lower edges 64,66, respectively. From the foregoing, it is apparent that once the wear areas A and B are utilized, bit 14 can be flipped over in place at corner 18 to expose wear areas C and D or can be reversed to from corner 18 to corner 16 and the indexing process can be repeated to expose the wear areas designated C and D. Thus, upper edge 64 of bit 14 will become the lower edge and lower edge 66 will become the upper edge. Similarly, bit 12 can be reversed from corner 16 to corner 18.

In operation, bit 4 is secured to blade corner 18 by bolts 62. The apertures of row 52 are aligned with corresponding apertures on blade 10, and wear area A is exposed. After substantial use, wear area A is diminished and lower edge 66 recedes to a dotted line separating areas A and B. Bit 14 can now be indexed with respect to blade 10 by aligning the apertures of row 42 with corresponding apertures in blade 10. Thus, wear area B is now exposed and eventually becomes diminished as its lower edge recedes to the next dotted line. Similarly, wear areas A and B of bit 12 are diminished at corner 16 of the blade. At this point bits 12,14 can either be interchanged by rotating 180°, thus exposing wear surfaces C and ultimately D, or can be flipped over in place for exposing wear surfaces C and D.

The foregoing has illustrated a reversible, indexible bit which provides new material all along the lower or exposed edge of the bit and includes an increased amount of material at the outside blade corners where the greatest amount of blade wear normally occurs.

The embodiments of the invention in which an exclusive property or privilege is claimed are defined as follows:

1. An end wear bit for earthmoving equipment blades, comprising:

a reversible plate having a first short edge, an opposed second relatively longer edge, first and second opposite wear edges, first and second symmetrical halves, and a plurality of rows of apertures divergent relative to each other and divergent relative to the first and second opposite wear edges and extending between the first short edge and the second longer edge.

2. The end wear bit of claim 1, wherein the apertures are substantially equidistantly spaced along each divergent row.

3. The end wear bit of claim 2, wherein the apertures are at locations sufficient for indexing the bit with respect to the blade.

4. The end wear bit of claim 3, wherein the number of rows of the first half equals the number of rows of the second half.

5. The end wear bit of claim 1, wherein the plate is of a construction sufficient for indexing from row to divergent row and progressively exposing new material, the new exposed material being a first preselected amount adjacent the first short edge and a second preselected amount adjacent the second longer edge, the second preselected amount being greater than the first preselected amount.

* * * * *